US008789506B2

(12) United States Patent
Poskie

(10) Patent No.: US 8,789,506 B2
(45) Date of Patent: Jul. 29, 2014

(54) ROCKER ARM ASSEMBLY INCLUDING LASH ADJUSTMENT ARM AND METHOD OF ASSEMBLY

(75) Inventor: Fredrick R. Poskie, Plymouth, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 548 days.

(21) Appl. No.: 13/040,566

(22) Filed: Mar. 4, 2011

(65) Prior Publication Data

US 2012/0222303 A1 Sep. 6, 2012

(51) Int. Cl.
*F01L 1/18* (2006.01)

(52) U.S. Cl.
USPC ..... 123/90.41; 123/90.43; 123/90.45

(58) Field of Classification Search
USPC ..... 123/90.41, 90.43, 90.45
See application file for complete search history.

(56) References Cited

U.S. PATENT DOCUMENTS

| | | | | |
|---|---|---|---|---|
| 5,080,054 | A * | 1/1992 | Nakamura | 123/90.16 |
| 8,161,929 | B2 * | 4/2012 | Kuhl et al. | 123/90.48 |
| 2003/0121484 | A1 * | 7/2003 | Wang | 123/90.16 |
| 2007/0221153 | A1 * | 9/2007 | Curtis | 123/90.41 |

* cited by examiner

*Primary Examiner* — Thomas Denion
*Assistant Examiner* — Thomas Olszewski
(74) *Attorney, Agent, or Firm* — Harness, Dickey & Pierce, P.L.C.

(57) ABSTRACT

A rocker arm assembly may include a body, a cam follower and a lash adjustment member. The body may define a pivot region and a valve engagement region. The cam follower may be coupled to the body. The lash adjustment member may be coupled to the cam follower and may include a locking portion and an adjustment arm extending radially outward from the cam follower.

15 Claims, 1 Drawing Sheet

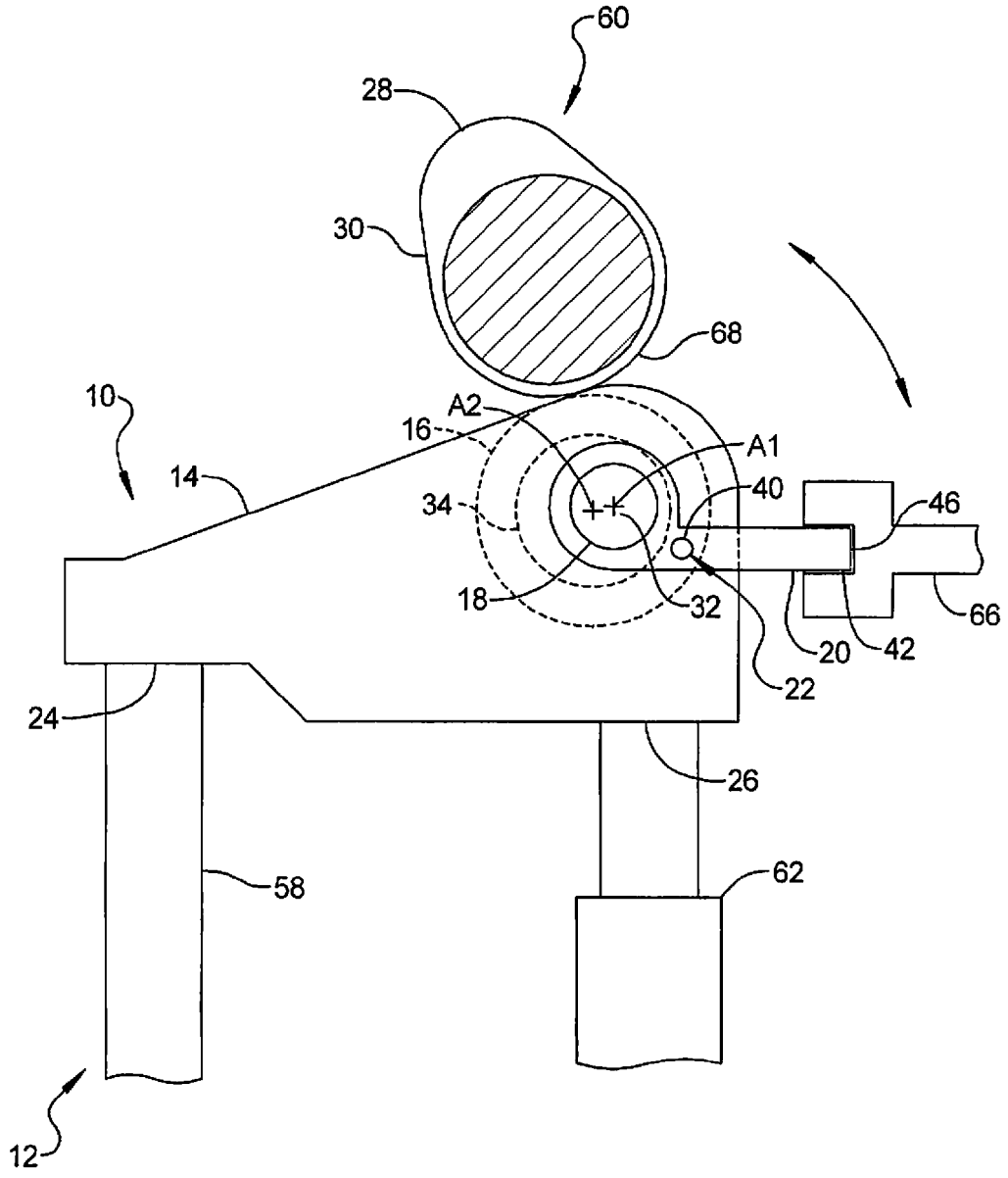
60
28
30
68
10
A2
16
A1
14
40
46
34
18
32
66
20
42
22
24
26
58
62
12

ROCKER ARM ASSEMBLY INCLUDING LASH ADJUSTMENT ARM AND METHOD OF ASSEMBLY

FIELD

The present disclosure relates to engine rocker arm assemblies.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Engines may include intake ports to direct and air flow to the combustion chambers and exhaust ports to direct exhaust gases from the combustion chambers. Camshafts may be engaged with rocker arms to displace intake and exhaust valves between open and closed positions to selectively open and close the intake and exhaust valves.

SUMMARY

A rocker arm assembly may include a body, a cam follower and a lash adjustment member. The body may define a pivot region and a valve engagement region. The cam follower may be coupled to the body. The lash adjustment member may be coupled to the cam follower and may include a locking portion and an adjustment arm extending radially outward from the cam follower.

During assembly, the rocker arm assembly may be located on a fixture defining a pivot support member and the cam follower may be engaged with a cam member. The adjustment arm may be displaced to displace the cam follower and pivot the body of the rocker arm assembly to provide a predetermined displacement of the valve engagement region of the rocker arm assembly. The cam follower may be secured relative to the body via the lash adjustment member after the predetermined displacement.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawing described herein is for illustrative purposes only and are not intended to limit the scope of the present disclosure in any way.

The FIGURE is a schematic illustration of a rocker arm assembly and an assembly fixture according to the present disclosure.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

A rocker arm assembly 10 and assembly fixture 12 are illustrated in the FIGURE. The rocker arm assembly 10 may include a body 14, a cam follower 16, an eccentric shaft 18, a lash adjustment member 20 and a lock assembly 22. The body 14 may define a pivot region 24 at a first end and a valve engagement region 26 at a second end opposite the first end. The pivot region 24 may support the rocker arm assembly 10 on a support member and the valve engagement region 26 may be engaged with an intake or exhaust valve (not shown) and may displace the intake or exhaust valve when the rocker arm assembly 10 is engaged by a peak 28 of a cam lobe 30.

The cam follower 16 may be coupled to the body 14 and may be engaged with the cam lobe 30. More specifically, the cam follower 16 may be supported for rotation on the eccentric shaft 18. The eccentric shaft 18 may be supported on the body 14 and may include a first shaft portion 32 and a second shaft portion 34. The first shaft portion 32 may be supported on the body 14 and may be rotatable relative to the body 14. The first shaft portion 32 may be located at axial ends of the eccentric shaft 18 and may define a first central longitudinal axis (A1). The second shaft portion 34 may be located between the axial ends of the eccentric shaft 18 and may define a second central longitudinal axis (A2) radially offset from the first central longitudinal axis (A1). The eccentric shaft 18 may be rotatable about the first central longitudinal axis (A1) on the body 14 and the cam follower 16 may be supported for rotation on the second shaft portion 34 of the eccentric shaft 18.

The lash adjustment member 20 may be fixed for rotation with the first shaft portion 32 of the eccentric shaft 18. More specifically, the lash adjustment member 20 may be fixed to the first shaft portion 32 for rotation about the first central longitudinal axis (A1). The lash adjustment member 20 may include a locking portion 40 and an adjustment arm 42 extending radially outward from the cam follower 16 and the eccentric shaft 18. The locking portion 40 may be engaged with the lock assembly 22. For simplicity, and for purposes of illustration only, the lock assembly 22 may be in the form of a set screw engaged with the locking portion 40 of the lash adjustment member 20. The adjustment arm 42 may extend radially outward from the locking portion 40 and the cam follower 16. More specifically, an end 46 of the adjustment arm 42 may be located radially outward from an outer periphery of the cam follower 16.

During assembly, the lash adjustment member 20 may be used to adjust the position of the cam follower 16 relative to the body 14 of the rocker arm assembly 10 to provide a predetermined valve lash when the rocker arm assembly 10 is included in an engine assembly. The rocker arm assembly 10 may be located on the fixture 12 to adjust the position of the cam follower 16. The fixture 12 may include a pivot support member 58, a cam member 60 and a linear transducer 62.

The pivot region 24 may be supported on the pivot support member 58, the valve engagement region 26 may be engaged with the linear transducer 62 and the cam member 60 may be located adjacent to the cam follower 16. The lock assembly 22 may be disengaged from the lash adjustment member 20 and the adjustment arm 42 may be rotated to provide engagement between the cam member 60 and the cam follower 16. The engagement between the cam follower 16 and the cam member 60 may result in displacement of the valve engagement region 26. The adjustment arm 42 may be displaced until a predetermined displacement of the valve engagement region 26 is achieved. More specifically, the displacement of the valve engagement region 26 may result in displacement of the linear transducer 62 and the adjustment arm 42 may be displaced until the linear transducer 62 is displaced to a predetermined position. After the predetermined displacement is achieved, the lock assembly 22 may be returned to a locked position and the cam follower 16 may be secured relative to the body 14 of the rocker arm assembly 10.

A tool 66 may engage the end 46 of the adjustment arm 42 to adjust the position of the cam follower 16 by rotating the adjustment arm 42 relative to the body 14 of the rocker arm assembly 10. The displacement of the adjustment arm 42 may include rotating the eccentric shaft 18 about the first central longitudinal axis (A1).

The cam member 60 may include the cam lobe 30. The displacement of the adjustment arm 42 may occur when a base circle region 68 of the cam lobe 30 is engaged with the cam follower 16. The rotation of the eccentric shaft 18 discussed above, may adjust a radial clearance between the cam follower 16 and the cam lobe 30 to provide a predetermined engagement between the rocker arm assembly 10 and the cam lobe 30 when the rocker arm assembly is incorporated into an engine assembly.

What is claimed is:

1. A rocker arm assembly comprising:

a body defining a pivot region and a valve engagement region;

a cam follower coupled to the body;

a lash adjustment member coupled to the cam follower and including a locking portion and an adjustment arm extending radially outward from the cam follower; and an eccentric shaft supported on the body, the cam follower located on the eccentric shaft and the lash adjustment member fixed to the eccentric shaft for rotation with the eccentric shaft.

2. The rocker arm assembly of claim 1, wherein an end of the adjustment arm is located radially outward from an outer periphery of the cam follower.

3. The rocker arm assembly of claim 1, wherein the eccentric shaft includes a first shaft portion and a second shaft portion, the first shaft portion fixed for rotation with the lash adjustment member, supported for rotation on the body and defining a first central longitudinal axis, the second shaft portion defining a second central longitudinal axis radially offset from the first central longitudinal axis and supporting the cam follower.

4. The rocker arm assembly of claim 3, wherein the cam follower is supported for rotation on the second shaft portion, the first central longitudinal axis defines an axis of rotation for the eccentric shaft relative to the body and the second central longitudinal axis defines an axis of rotation for the cam follower relative to the body.

5. The rocker arm assembly of claim 4, wherein displacement of the adjustment arm rotates the eccentric shaft relative to the body and adjusts a radial clearance between the cam follower and an adjacent cam lobe.

6. The rocker arm assembly of claim 1, wherein the adjustment arm extends radially outward relative to the eccentric shaft.

7. The rocker arm assembly of claim 1, further comprising a lock assembly engaged with the body and displaceable between a locked position where the locking portion of the lash adjustment member is engaged with the lock assembly rotationally fixing the eccentric shaft relative to the body and an unlocked position where the lash adjustment member and the eccentric shaft are rotatable relative to the body.

8. A method comprising:

locating a rocker arm assembly on a fixture defining a pivot support member, the rocker arm assembly including a body defining a pivot region supported on the pivot support member, a valve engagement region, a cam follower coupled to the body, and a lash adjustment member coupled to the cam follower and including a locking portion and an adjustment arm extending radially outward from the cam follower;

engaging the cam follower with a cam member;

displacing the adjustment arm to displace the cam follower and pivot the body of the rocker arm assembly to provide a predetermined displacement of the valve engagement region of the rocker arm assembly; and securing the cam follower relative to the body via the lash adjustment member after the predetermined displacement, wherein displacing the adjustment arm includes engaging an end of the adjustment arm located radially outward from an outer periphery of the cam follower and rotating the adjustment arm relative to the body of the rocker arm assembly.

9. The method of claim 8, further comprising disengaging a lock assembly from the lash adjustment member and displacing the adjustment arm.

10. The method of claim 8, wherein the rocker arm assembly includes an eccentric shaft supported on the body with the cam follower located on the eccentric shaft and the lash adjustment member fixed to the eccentric shaft for rotation with the eccentric shaft, displacing the adjustment arm including the adjustment arm rotating the eccentric shaft.

11. The method of claim 10, wherein the eccentric shaft includes a first shaft portion and a second shaft portion, the first shaft portion fixed for rotation with the lash adjustment member, supported for rotation on the body and defining a first central longitudinal axis, the second shaft portion defining a second central longitudinal axis radially offset from the first central longitudinal axis and supporting the cam follower, the displacing including rotating the eccentric shaft about the first central longitudinal axis.

12. The method of claim 11, wherein the second central longitudinal axis defines an axis of rotation for the cam follower relative to the body and rotation of the eccentric shaft via the adjustment arm adjusts a radial clearance between the cam follower and the cam member.

13. The method of claim 8, wherein the cam member includes a cam lobe engaged with the cam follower.

14. The method of claim 8, wherein the displacing the adjustment arm occurs when a base circle region of the cam member is engaged with the cam follower.

15. The method of claim 8, wherein the fixture includes a linear transducer engaged with the valve engagement region of the rocker arm assembly and the cam follower is secured relative to the body after the linear transducer is displaced to a predetermined position.

* * * * *